US010689804B2

(12) United States Patent
Rubin et al.

(10) Patent No.: US 10,689,804 B2
(45) Date of Patent: Jun. 23, 2020

(54) TEXTILE PRODUCT HAVING LATENT IMAGE THAT SLOWLY APPEARS FOLLOWING REPEATED WASHINGS

(71) Applicants: Robert T. Rubin, Oxnard, CA (US); Ricardo Fonseca Nuño, Oxnard, CA (US)

(72) Inventors: Robert T. Rubin, Oxnard, CA (US); Ricardo Fonseca Nuño, Oxnard, CA (US)

(73) Assignee: Robert T Rubin, Oxnard, CA (US)

( * ) Notice: Subject to any disclaimer, the term of this patent is extended or adjusted under 35 U.S.C. 154(b) by 0 days.

(21) Appl. No.: 16/391,620

(22) Filed: Apr. 23, 2019

(65) Prior Publication Data

US 2019/0330797 A1 Oct. 31, 2019

Related U.S. Application Data

(60) Provisional application No. 62/664,465, filed on Apr. 30, 2018, provisional application No. 62/811,846, filed on Feb. 28, 2019.

(51) Int. Cl.

| | |
|---|---|
| ***D06P 5/00*** | (2006.01) |
| ***D06B 11/00*** | (2006.01) |
| ***B44F 1/10*** | (2006.01) |
| ***A41B 1/08*** | (2006.01) |

(52) U.S. Cl.

CPC ..... *D06P 5/001* (2013.01); *A41B 1/08* (2013.01); *B44F 1/10* (2013.01); *D06B 11/0056* (2013.01)

(58) Field of Classification Search

None

See application file for complete search history.

(56) References Cited

U.S. PATENT DOCUMENTS

| | | | | |
|---|---|---|---|---|
| 4,216,591 | A * | 8/1980 | Bubley | F26B 3/283 34/421 |
| 4,900,617 | A * | 2/1990 | Smith | C09D 5/008 273/139 |
| 5,260,118 | A * | 11/1993 | Lussi | B29C 67/0007 428/202 |
| 2002/0187315 | A1* | 12/2002 | Tanel | A47L 23/266 428/204 |
| 2016/0200090 | A1* | 7/2016 | Fuqua | B41M 1/12 101/126 |

(Continued)

FOREIGN PATENT DOCUMENTS

WO WO-2016166489 A1 * 10/2016 ..... B32B 27/40

OTHER PUBLICATIONS

"Trojan horse t-shirt trick neo-Nazis" (via https://www.reuters.com/article/us-germany-shirts/trojan-horse-t-shirts-trick-neo-nazis-idUSTRE7792CP20110810?feedType=RSS&feedName=oddlyEnoughNews&rpc=22&sp=true, Aug. 10, 2011 (Year: 2011).*

(Continued)

*Primary Examiner* — Laura C Powers

(74) *Attorney, Agent, or Firm* — Ralph D. Chabot

(57) ABSTRACT

A textile product is disclosed having a latent image created from water-based ink which is applied using a screen printing process. The image is thereafter hidden underneath a second image created from a plasticizing emulsion such as plastisol which is partially cured. The partial cure causes a portion of the plasticizing emulsion to be removed from the textile product during washing and after repeated washings, the latent image becomes revealed.

8 Claims, 2 Drawing Sheets

(56) References Cited

U.S. PATENT DOCUMENTS

| | | | | |
|---|---|---|---|---|
| 2017/0095021 | A1* | 4/2017 | Eleish | A41B 1/00 |
| 2017/0173994 | A1* | 6/2017 | Almasanu | B43L 1/00 |
| 2018/0105980 | A1* | 4/2018 | Devidal | B32B 27/40 |

OTHER PUBLICATIONS

"A Guide to Long-Lasting Screen Prints: Tips for Proper Curing" (https://anatol.com/a-guide-to-long-lasting-screen-prints-tips-for-proper-curing/, Apr. 6, 2017; (Year: 2017).*

15370PFX Epic Silver Shimmer Safety Data Sheet, Revision Date Aug. 11, 2017 POLYONE Corporation, Avon Lake, OH.

Wikipedia citation for Plastisol, https://en.wikipedia.org/wiki/Plastisol dated Oct. 11, 2019.

* cited by examiner

TEXTILE PRODUCT HAVING LATENT IMAGE THAT SLOWLY APPEARS FOLLOWING REPEATED WASHINGS

BACKGROUND OF THE INVENTION

1. Field of the Invention

The present invention relates broadly to the field of printing images onto garments.

2. Summary of the Prior Art

Screen printing, sometimes referred to as "silk screening" is a well-known method for creating images such as lettering, graphics and images onto article of clothing such as t-shirts, jerseys, etc. A screen printing machine is used for creating the images onto articles of clothing.

Screen printing typically falls into one of two categories.

The first category is creation of the images using water-based ink. Water-based ink is used in which the ink dye penetrates into the fibers of the clothing. Thereafter, the article of clothing is dried, typically in a tunnel oven at about 420 deg F. to ensure permanence in the fabric. The resulting garment has a durable image.

The second category is creation of images using a plasticizing emulsion which is thereafter cured. Most common is the use of plastisol that includes colored polyvinyl chloride (PVC) particles suspended in the plasticizing emulsion which provides color. Rather than penetrating the fabric as the case with water-based inks, these plasticizing emulsions are more of a coating which is applied onto the top or outer surface of the garment or clothing substrate. Upon application to the article of clothing, plastisol does not dry and requires heating to about 350 deg F. in order to achieve a full cure. The final product is images essentially permanently affixed upon the clothing substrate having a raised, plasticized texture.

SUMMARY OF THE INVENTION

Described herein is: 1) a textile product having at least two images where the second image obscures at least a portion of the first image until the textile product is repeatedly washed a sufficient number of times before incrementally revealing a progressively greater portion of the underlying first image; and, 2) a method for applying images to a textile article using water based inks and thereafter having the at least a portion of the images temporarily hidden by application of a layer of a partially cured plasticizing emulsion. Preferably, the plasticizing emulsion is plastisol.

The term "textile article" refers to items that can have a first image applied by a screen printing process. Such items can include but are not limited to, an article of clothing such as a shirt or T-shirt, towel, wash cloth, etc.

The term "textile product" can refer to various items, including, but not limited to articles of clothing, towels, wash cloths, etc. that have at least a portion of a first image hidden by a second image as described above.

As used herein, the term "image" can refer to any application of water-based ink or plasticizing emulsion onto a textile article using a screen printing process.

As used herein, the term "garment" refers to a textile product comprising two images created on the article of clothing; a first image; and, a partially cured second image created from a plasticizing emulsion applied directly upon at least a portion of the first image.

The first image is created using a screen printing process, preferably with water-based ink which is resistant to repeated exposure to washings at high or low temperatures. Preferably, a permanent, environmentally friendly non-toxic textile ink is used.

A second image is applied directly upon at least a portion of the first image. This second image is applied using a screen printing process with plasticizing emulsion. Thereafter, rather than exposing the plasticizing emulsion to sufficient heat necessary to fully cure, a lower temperature is used to only partially cure the plasticizing emulsion. Since the plasticizing emulsion is only partially cured, it will wear off the garment after repeated washings in a washing machine. The number of washings required for the second image to wear off is a function of the plasticizing emulsion used, the temperature of the partial cure and the temperature used during the washing of the garment. The lower the partial cure temperature, the fewer washings will be required for the first image to be revealed.

The second image thus described could also comprise multiple images. In other words, the second image is not limited to a single image covering at least a portion of the first image. The second image could comprise two or more separate images covering respective areas of the first image. As used herein, "second image" refers to any deposit of plasticizing emulsion which covers at least a portion of the first image.

At least a portion of the first image is a latent image. Accordingly, it is desired that the first image become substantially viewable after a reasonable number of washings. Some may prefer that the first image become revealed after only one or two washings while others may prefer additional washings before the first image is revealed. This would be decided by the manufacturer and be based upon customer demand. Having the partial cure temperature too close to the full cure temperature will mean the latent image may take too long to appear for customers. Conversely, having the partial cure temperature too low, the second image will not be dry to the touch and will be easily removed in only one wash cycle.

It has been discovered that an optimum temperature range to partially cure a plastisol image on an article of clothing such as a T-shirt is between 210 deg F. and 250 deg F. Partial curing below 210 deg F. will yield an image that will wear off in only one or two washings; while partial curing above 250 deg F. will produce a plastisol layer that is quite resistant to removal.

As described earlier, the rate at which the plastisol layer will wear off or fade also is dependent upon the temperature of the wash cycle. Washing with hot water will more rapidly cause the plastisol layer to disappear compared to washing the garment in cold water.

Garments, particularly thin apparel such as T-shirts, shirts, blouses, socks etc. can be adapted to incorporate plasticizing emulsion based non-toxic dyes that can be used to create and temporarily hide water-based images. With repeated washing, additional portions of the second image are washed away to progressively reveal a greater portion of the first image.

The first image, sometimes referred to as the latent image, can be created using water based inks. The latent image, upon the article of clothing being dried, would be more resistant to fading or wear than the partially cured second image. The partially cured second image would be created upon the article of clothing to at least partially hide the first image. The second image is applied and partially cured to the desired temperature.

In another embodiment of the invention, latent images could be created using water based inks. The images would be covered by a partially cured image comprising a darker dye as part of a plasticizing emulsion that is designed to slowly wear off, dissolve or fade or become lightened after repeated washings, revealing the latent image.

In another embodiment of the invention, latent images could be dyed into an item of clothing; e.g., a T-shirt, having a latent image wherein portions of the image are made of different dye formulations so that portions of the image will emerge after a different number of washings. For example, one portion may emerge after two washings while another portion of the latent image will emerge after 4 washings, etc. so that the full image develops only over time. This would enhance the "mystery" aspect of the first image; e.g., one portion of the image being the paws of an animal which would appear before the rest of the animal image.

In still another embodiment of the invention, following the application of the first image using a screen printing process with water-based ink, the second image is created from plasticizing emulsions partially cured at different temperatures. For example, if a portion of the second image is to last longer than other portions, that portion is a first application of a layer of plasticizing emulsion applied directly upon a portion of the first image and is thereafter partially cured at a pre-determined temperature. Next, a second application of a layer of plasticizing emulsion is applied upon a remaining portion of the first image not covered by the first application, and where the second application is thereafter partially cured at a temperature lower than the pre-determined temperature of the first application. By way of example, assume the first image is of an animal having penetrating eyes and the manufacturer desired the eyes to appear before the remaining portion of the latent image. A first application of plasticizing emulsion would be applied to cover the first image except for the penetrating eyes. The plasticizing emulsion would be partially cured at a pre-determined temperature. After cooling of the article of clothing, a second application of plasticizing emulsion would thereafter be applied upon the penetrating eyes of the first image and partially cured at a temperature lower than the pre-determined temperature of the first application. For this example, the areas of the second image partially cured at a lower temperature would wear off as a result of repeated washings before the other portions of the second image partially cured at a higher temperature. Thus, the penetrating eyes would be revealed before the remainder of the first image.

In another embodiment, after the water-based first image is applied, a transparent layer of plasticizing emulsion is applied upon at least a portion of the first image and thereafter fully cured. Thereafter, a second image is applied and partially cured. The purpose of the transparent layer is to maintain the vibrant color of the water-based ink so that fading of the color is substantially reduced as the garment is subjected to multiple washings.

In another embodiment, rather than using a water-based first image, the first image is instead made of a plasticizing emulsion which is fully cured. Thereafter, a second image, made again of a plasticizing emulsion, is applied to at least a portion of the first image and then partially cured.

Images could be targeted at different age groups and sexes. For example, for small girls, a latent image of a princess could be placed on a T-shirt, and for small boys, the latent image could be of a zombie or superhero.

The second image could be slowly replaced with repeated washings with the first image. Examples include an image of a boy changing into a zombie, or an image of a girl changing into a mermaid.

A series of images; e.g., different animals, could be marketed for different garments, which would encourage parents to purchase multiple garments over time. Similarly, latent images designed for adults, with appropriate slogans, could be placed on T-shirts or other items; e.g., towels, to be used as surprise gifts. Different articles of clothing could also be treated such as underwear, socks, and pajamas.

The "delayed gratification" aspect of a latent image slowly appearing would especially keep children wondering and engaged. Use of a series of images; e.g., different animals, would further keep children engaged, as they would want the series on multiple clothing items to see all the animals appear.

An added advantage is that children would give up their clothing for washing at the appropriate time, because they will want to see how different it looks after it's clean once again, thus aiding parents in their attempts to keep their children's clothing clean.

In still another embodiment, the textile article comprises a first image already created using a screen printing or other process. In other words, a textile article such as a T-shirt can be purchased already having a first image that has been applied by screen printing, free-hand drawing, etc. At a time subsequent to purchase, the second image is applied directly upon at least a portion of the first image and partially cured to cover the earlier image and thus create the textile product.

Many modifications and other embodiments of the inventions set forth herein will come to mind to one skilled in the art to which these inventions pertain having the benefit of the teachings presented in the foregoing descriptions and the associated drawings. Therefore, it is to be understood that the methods and garments described herein are not to be limited to the specific embodiments disclosed and that modifications and other embodiments are intended to be included within the scope of the claims.

DETAILED DESCRIPTION OF THE PREFERRED EMBODIMENT

The textile product described in this section is a garment and the textile article is an article of clothing, namely a T-shirt.

Figure 1:
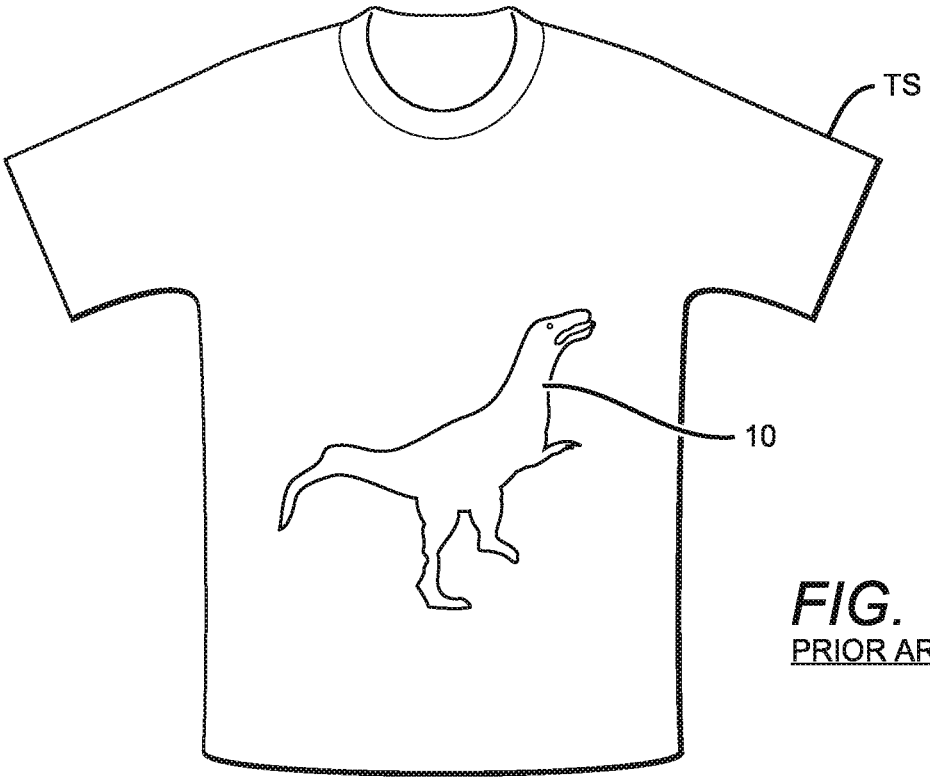
FIG. 1 PRIOR ART
FIG. 1 is a prior art representation of a T-shirt having a first image created using a screen printing process.

FIG. 1 is a representation of a T-shirt TS having a first image 10 created using a screen printing process.

A screen printing machine (not shown) is used to create first image 10 upon T-shirt TS. Water-based inks (CCI Boost Pigment Concentrate+water) are used and after the image is applied, T-shirt TS is passed thru a tunnel dryer (not shown) at about 420 deg F. For purposes of illustration, first image 10 is that of a dinosaur although any image can be created using this well-known prior art screen printing process.

Figure 2:
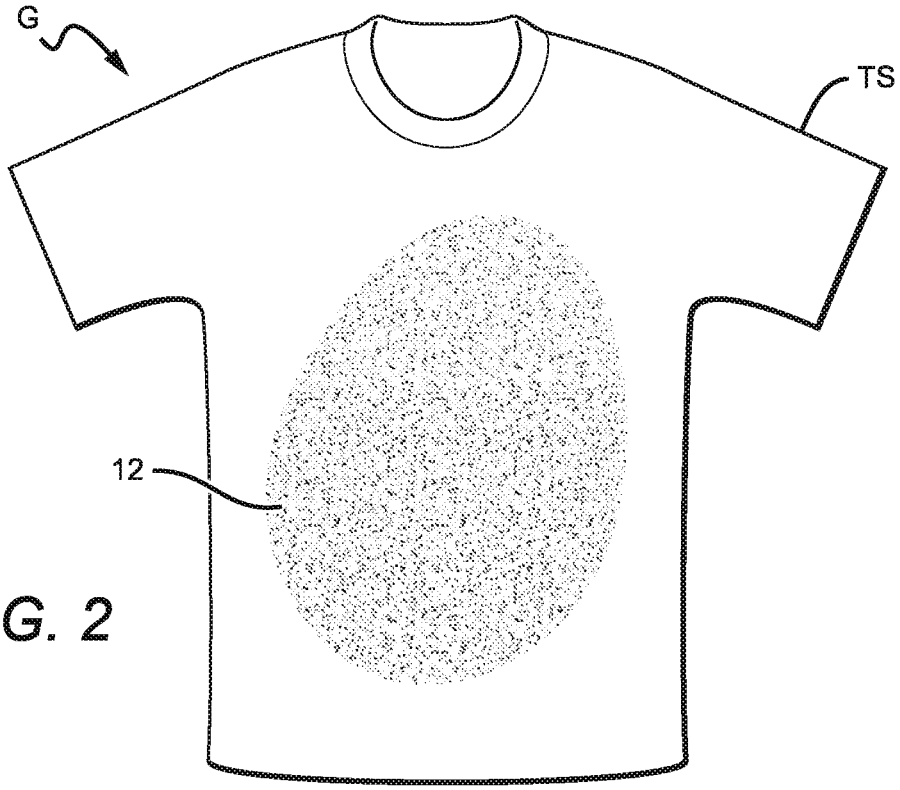
FIG. 2 illustrates the appearance of the T-shirt of FIG. 1 having a second image applied to obscure the first image using a screen printing process.

A second image 12, opaque in appearance and in the shape of an egg, is applied to T-shirt TS to obscure first image 10. A representation of the appearance of the T-shirt after application and partial cure of second image 12 is illustrated in FIG. 2. Following application and partial cure of second image 12, T-shirt TS, first image 10 and second image 12 are collectively referred to as garment G.

For determining the optimum partial cure temperature for the plastisol second image 12, multiple all-cotton T-shirts were used; each of which had a first image 10 depicting a dinosaur as described above.

The next step was to apply the plastisol second image to each T-shirt TS but partially cure the T-shirts separately at different temperatures.

After the T-shirts TS were printed with the dinosaur first image, dried using a tunnel dryer and thereafter allowed to cool, a screen printing machine was used to apply the second image using plastisol. The purpose is for the second image to cover at least a portion of the first image. In the example described herein, first image 10 is completely covered by second image 12 which is of an egg and the second image was comprised of silver plastisol (Wilflex Epic Silver Shimmer, manufactured by PolyOne, Inc.).

The following partial cure temperatures were evaluated: 180, 190, 200, 210, 220, 225, 230, 240, and 250 deg F. The objective was to determine how many washings would be required before the latent dinosaur image would come into view.

The T-shirts were thereafter repeatedly washed in a home washing machine. T-shirts were separated and washed separately. Some were washed on a normal cycle (59 min total; warm water wash; with one Tide 4-in-1 detergent pad added) and dried in a home drier on normal cycle (59 min).

Table 1 is a comparison of the number of washings required to reveal the latent image using various partial cure temperatures for a second image made from PolyOne 15370 PFX Epic Silver Shimmer Plastisol:

TABLE 1

PolyOne 15370 PFX Epic Silver Shimmer Plastisol Cover

| Partial Cure Temperature | # of Washes For 50% Image Reveal | # of Washes For Full Image Reveal |
|---|---|---|
| 180 F. | N/A (too gummy) | N/A (too gummy) |
| 190 F. | N/A (too gummy) | N/A (too gummy) |
| 200 F. | 1 | 1 |
| 210 F. | 1 | 1 |
| 220 F. | 1 to 2 | 5 to 6 |
| 225 F. | 3 to 4 | 7 to 8 |
| 230 F. | 4 to 5 | 9 to 10 |
| 240 F. | 6 to 7 | >10 |
| 250 F. | >10 | >10 |

For 180 and 190 deg F., the temperatures were insufficient to obtain an adequate partial cure. The plastisol was gummy to the touch prior to washing, and separated from the T-shirts and formed chunks in the washer as well as stained the T-shirts.

At the higher temperature levels of 240 and 250 deg F., the partial cure to the garment resulted in the plastisol adhering to the T-shirts so well that the second image remained intact after 10 washes.

At 200-210 deg F., substantially all of the dinosaur first image was viewable after one wash.

Figure 3:
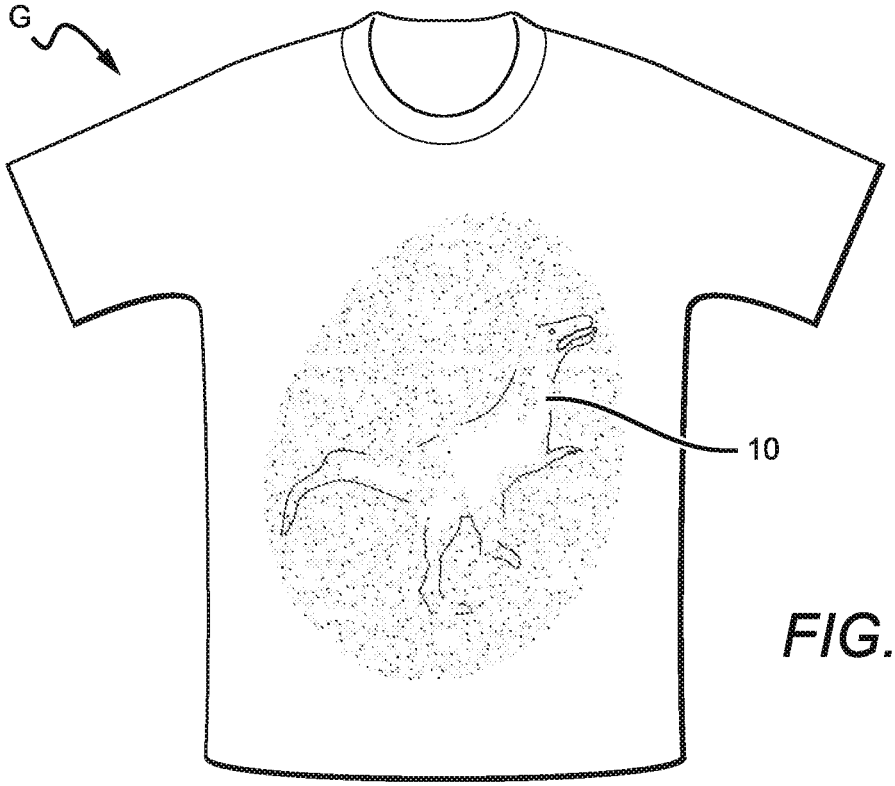
FIG. 3 illustrates the appearance of the T-shirt of FIG. 2 following a second wash; and, FIG. 4 is illustrates the appearance of the t-shirt of FIG. 3 after a third wash.
Figure 4:
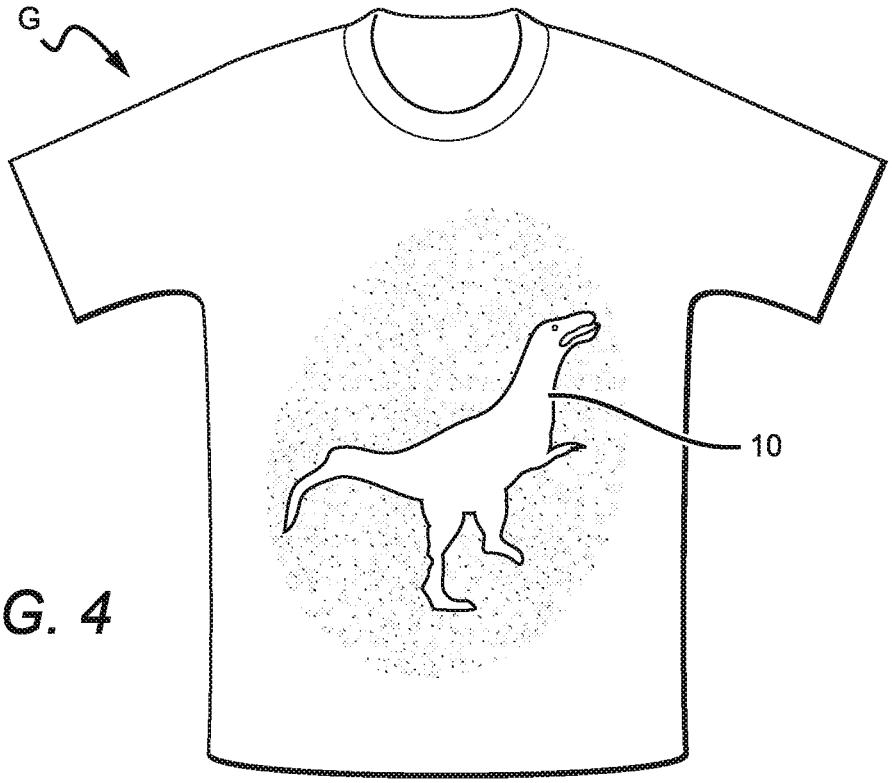

At 220 deg F., some coloration of the dinosaur image appeared after one wash, but the outline of the first image remained somewhat obscured. After the second wash, between approximately 25-50% of the dinosaur image 10 was viewable in FIG. 3; and 75% or greater of the dinosaur image 10 is viewable after the third wash as illustrated in FIG. 4. There was little further development of the image after the fourth and fifth washes.

At a slightly higher temperature of 225 and 230 deg F., the plastisol image washed off more slowly, such that after three washes about 33% of the dinosaur image was visible.

Thus, the working temperature range for plastisol for achieving a desired partial cure to all-cotton T-shirts occurs between 200 deg F. and 230 deg F.

Based on the above, a partial cure temperature of about 220 deg F. for plastisol will cause first image to become mostly visible will be about 220 deg F. after between about 4-6 washes.

With the top layer comprising silver plastisol alone, it was noted that, when orientating the T-shirt into certain positions under a light source, the reflectivity allowed portions of the dinosaur outline to be somewhat discernible. It then was determined that the addition of mottled brown plastisol spots to the silver plastisol would adequately cover the latent image. The removal characteristics of the brown and silver plastisol were similar to those of the silver plastisol alone at the temperatures tested (200, 210, 220, 225, and 230 deg F.).

It also was determined that the wash-water temperature affected the removal of the plastisol. T-shirts with a dinosaur image and overprinted with silver plastisol partially cured to 230 deg F. were washed repeatedly on normal cycle in cold, warm, and extra-hot water (59 minutes total; one Tide 4-in-1 detergent pad added) and dried on normal cycle (59 min).

TABLE 2

Wash Temperature (Normal Cycle, 59 min); Plastisol Cured at 230 F.

| Temperature | # of Washes For 50% Image Reveal | # of Washes For Full Image Reveal |
|---|---|---|
| Cold | 5 to 6 | >10 |
| Warm | 4 to 5 | 9-10 |
| Extra Hot | 2 to 3 | 8-9 |

For the dinosaur to be discernible it required approximately 5 to 6 washes using cold water, 4 to 5 washes using warm water, or 2 to 3 washes using hot water. Wash-water temperature thus affected the rapidity of plastisol removal, the slowest occurring in cold wash, and the greatest occurring in extra hot wash.

Based on the above, about 220 deg F. is believed to be an optimum temperature to partially cure the second image made of plastisol since a higher cure temperature will require an unreasonably high number of washings to reveal the hidden image and thus may discourage the wearer. Consequently, a lower cure temperature will require fewer washings and the novelty of the product may be lost if the hidden image is shown after only a couple of washings.

We claim:

1. A garment comprising:

a first image applied to a textile article using a screen printing process with water-based ink; and, a second image applied to the textile article to hide at least a portion of the first image, using a screen printing process with an uncured plastisol where the second image is thereafter partially cured at a curing temperature of between 220-250 deg F.;

wherein about 50% of the first image will not become visible until the garment is subjected to more than one wash.

2. The garment of claim 1 where a layer of transparent plasticizing emulsion is applied directly upon a least a portion of the first image, using a screen printing process and thereafter fully cured prior to the second image being applied to the textile article.

3. A garment comprising:

a first image applied to an article of clothing using a screen printing process with water-based ink;

a second image applied directly upon at least a portion of the first image using a screen printing process and plasticizing emulsion comprising:

a first application of a layer of an uncured plasticizing emulsion is applied directly upon a portion of the first image and is thereafter partially cured at a pre-determined curing temperature between 230-240 deg F.; and, a second application of a layer of an uncured plasticizing emulsion is applied upon a remaining portion of the first image not covered by the first application, and where the second application is thereafter partially cured at a temperature lower than the pre-determined temperature of the first application between 220-235 deg F.;

wherein about 50% of the first image will not become visible until the garment is subjected to more than one wash.

4. A method for making a latent image appear on a garment initially covered by a coating of partially cured plastisol comprising the steps of:

receiving a garment comprising a first image created from water-based ink used in a screen printing process, and a layer of plastisol deposited directly upon at least a portion of the first image; where the layer of plastisol has been partially cured at a curing temperature temperature of between 220-250 deg F.;

washing the garment in a washing machine to remove a portion of the plastisol layer wherein about 50% of the first image will not become visible until the garment is subjected to more than one wash; and, repeating the step of washing the garment in a washing machine to remove additional portions of the plastisol layer to progressively reveal a greater portion of the first image.

5. The garment of claim 1 wherein the second image completely hides the first image.

6. The garment of claim 3 wherein the second image completely hides the first image.

7. A garment comprising:

a first image applied to a textile article using a screen printing process with water-based ink; and, a second image applied to the textile article to completely hide the first image, using a screen printing process with an uncured plastisol where the second image is thereafter partially cured at a curing temperature of between 220-250 deg F.;

wherein about 50% of the first image will not become visible until the garment is subjected to more than one wash.

8. The garment of claim 7 where a layer of transparent plasticizing emulsion is applied directly upon a least a portion of the first image, using a screen printing process and thereafter fully cured prior to the second image being applied to the textile article.

* * * * *